United States Patent [19]

Hennemann

[11] Patent Number: 4,940,431

[45] Date of Patent: Jul. 10, 1990

[54] SERIES TERMINAL FOR TWO-WIRE POWER SUPPLY TO ELECTRICAL OR ELECTRONIC COMPONENTS, ESPECIALLY INITIATORS

[75] Inventor: Lothar-Roland Hennemann, Enger, Fed. Rep. of Germany

[73] Assignee: Wago Verwaltungsgesellschaft mbH, Minden, Fed. Rep. of Germany

[21] Appl. No.: 310,639

[22] Filed: Feb. 13, 1989

[30] Foreign Application Priority Data

Feb. 15, 1988 [DE] Fed. Rep. of Germany ..... 3805158

[51] Int. Cl.[5] ..... H01R 9/26

[52] U.S. Cl. ..... 439/716; 439/715

[58] Field of Search ..... 439/94, 712, 713, 709, 439/715, 716, 717, 723, 724

[56] References Cited

U.S. PATENT DOCUMENTS 4,171,861 10/1979 Hohorst ..... 439/94
4,795,376 1/1989 Franke et al. ..... 439/715

FOREIGN PATENT DOCUMENTS 3200420 7/1983 Fed. Rep. of Germany ..... 439/716
3225855 1/1984 Fed. Rep. of Germany ..... 439/716
2056791 3/1981 United Kingdom ..... 439/716

*Primary Examiner*—Neil Abrams
*Assistant Examiner*—Khiem Nguyen
*Attorney, Agent, or Firm*—Salter & Michaelson

[57] ABSTRACT

A series terminal with two supply line contact points for two-wire power supply to electrical or electronic components, especially initiators, with the supply line contact points being supplied with power through bridges starting from a feeder terminal. It is proposed to design the series terminal in a certain way so that it can be used at the same time as a feeder terminal. This is achieved by the fact that the bridge connectors for the supply line contact points are positioned with mirror symmetry relative to a plane of symmetry, but with the supply line contact points being on the same side of the plane of symmetry, and that the assembly rail latch base points of the series terminal have the same perpendicular distances relative to a central plane, with this central plane at the same time being the aforementioned plane of symmetry.

2 Claims, 2 Drawing Sheets

SERIES TERMINAL FOR TWO-WIRE POWER SUPPLY TO ELECTRICAL OR ELECTRONIC COMPONENTS, ESPECIALLY INITIATORS

BACKGROUND OF THE INVENTION

This invention concerns a series terminal with two supply wire contact points for two-wire power supply to electrical or electronic components, especially initiators, each of which is connected to the two supply wire contact points of a series terminal.

Series terminals of this type are known in practice primarily as initiator terminals; however, they can also be used to supply power to electrical or electronic components of any kind. To simplify the description, reference will be made below only to initiators, but without thereby limiting the possible use of these terminals to this specific type of electronic component.

Initiators, such as transducers, thyristors, or the like, are generally manufactured in practice as three-wire initiators. Two wires are used for the power supply and one wire to carry the output signal of the initiator. It is customary to connect all three wires to the series terminal associated with the particular initiator, which for this purpose also has a through wire with two contact points at the ends for its two supply wire contact points, so that the output signal is carried through the series terminal and can be tapped at the second contact point of the through wire opposite the input end.

It is also known how to equip series terminals of this type for multiple-wire initiators, for example four-wire initiators, with correspondingly multiple through wires, and to indicate the particular circuit condition and/or the power supply to the initiator connected to the series terminal by luminous indicators (for example, LED displays) built into the series terminal. Other supplementary equipment for series terminals for initiators is also possible in known ways, for example the incorporation of a ground wire connection terminal that makes contact with an assembly rail when the series terminal is put in place on it, which then serves as a ground bus for all of the series terminals resting on the assembly rail.

Independently of the multiple variations of design of such series terminals for initiators described briefly above, the invention is concerned with a fundamental problem that is present in all series terminals of this type known heretofore.

For two-wire power supply to initiators, it is well known that each supply wire contact point of the series terminals has bridge connectors for cross-bridging adjacent series terminals on an assembly rail, which then are supplied with power by jumpers running in the direction of the assembly rail, for example by individual bridges from terminal to terminal, or by jumpers for a number of terminals similar to a bus, starting from a so-called feeder terminal.

The use of only one feeder terminal for all initiator terminals located next to one another on an assembly rail substantially reduces the wiring expense for the power supply to the initiators, and if only one series terminal is used per initiator, it permits a clear and obvious power circuit assignment for each initiator.

However, it is a drawback that such feeder terminals always represent a special design that has to be stored separately by the user in addition to the initiator terminals and the necessary accessories, for example jumpers, terminal plates for the initiator contacts, and has to be classified for the particular need. The storage and classification expense is also increased in this case by the necessity of keeping two types of feeder terminals on hand, depending on whether the supply power line to the feeder terminal mounted on the assembly rail is desired from one side or the other of the assembly rail.

It is the purpose of this invention to eliminate the drawbacks mentioned above.

SUMMARY OF THE INVENTION

This problem is solved by a series terminal for initiators, the so-called initiator terminal, in which the bridge connectors for one supply line contact point, on the one hand, and the bridge connectors for the other supply line contact point, on the other hand, are located on opposite sides and with mirror symmetry relative to a plane of symmetry, and in which this plane of symmetry at the same time is the central plane extending in the direction of the assembly rail between the assembly rail latch base points of the series terminal located on opposite sides and at the same perpendicular distance from the central plane, and in which both supply wire contact points of the initiator terminal are also located on the same side of the plane of symmetry.

An initiator terminal with the above features pursuant to the invention can be used directly also as a feeder terminal. In this case, the supply wire contact points of the initiator terminal pursuant to the invention are used for the connection of the supply power feeders. It can optionally be used as a feeder terminal with the supply power being introduced from one side or the other of the assembly rail. The terminal pursuant to the invention then only has to be placed on the assembly rail rotated by 180°.

The teaching of the invention is based first on the idea that the supply wire contact points and the bridge connectors associated with them can be positioned locally independently of one another. It is only then possible to arrange both supply wire contact points on only one side of the defined plane of symmetry (as necessary for the intended use of the terminal pursuant to the invention as an initiator terminal, and likewise for the intended use of the same terminal as a feeder terminal), and nevertheless to provide at the same time that the particular associated bridge connectors are located on opposites sides from one another and with mirror symmetry relative to the mentioned plane of symmetry, which is necessary so that the terminal pursuant to the invention can optionally be mounted on the assembly rail rotated by 180°, without thereby making it impossible to bridge across adjacent series terminals for continuous power supply to the supply wire contact points.

Thus, for example, with the terminal pursuant to the invention it is possible to accomplish power feed from one side or the other of the assembly rail when using the terminal as a feeder terminal, and also optionally to connect the initiators optionally from one side or the other of the assembly rail when using the terminal as an initiator terminal, or to locate them on the opposite sides of the assembly rail. This can also be done in a mixture and/or alternately within a terminal block mounted on one and the same assembly rail.

While mirror symmetry relative to the plane of symmetry has to be observed in the placement of the bridge connectors, this is not always the case in the arrangement of the assembly rail latch base points on opposites sides of the so-called central plane (which is the plane extending in the direction of the assembly rail from which each of the assembly rail latch base points of the series terminal to the right and left of this plane have the same perpendicular distance). This depends on the particular assembly rail profile used. If the assembly rail profile has a shape with mirror symmetry, as is the case, for example, with an assembly rail according to European Standard EN 50022, then the assembly rail latch base points of the series terminal pursuant to the invention also have mirror symmetry relative to the so-called central plane. However, if an asymmetric assembly rail profile is used, for example according to European Standard EN 50035, then it must be provided according to the teaching of the invention that the assembly rail latch base points have the same perpendicular distance from the so-called central plane, so that when the series terminal pursuant to the invention is latched to the assembly rail optionally rotated by 180°, no lateral motion of the bridge connectors of the supply wire contact points can occur perpendicular to the assembly rail.

According to the teaching of the invention, the aforementioned central plane of the assembly rail latch base points should be identical with the plane of symmetry, with reference to which the bridge connectors of the supply wire contact points are positioned with mirror symmetry.

A particularly desirable embodiment of the invention provides that in series terminals whose external contour has an inscription surface or inscription groove extending in the direction of the assembly rail, this surface or groove is likewise positioned with mirror symmetry relative to the axis of symmetry.

Examples of embodiment of the invention are described in detail below with reference to the drawings. The drawings show:

DESCRIPTION OF THE INVENTION

Figure 1:
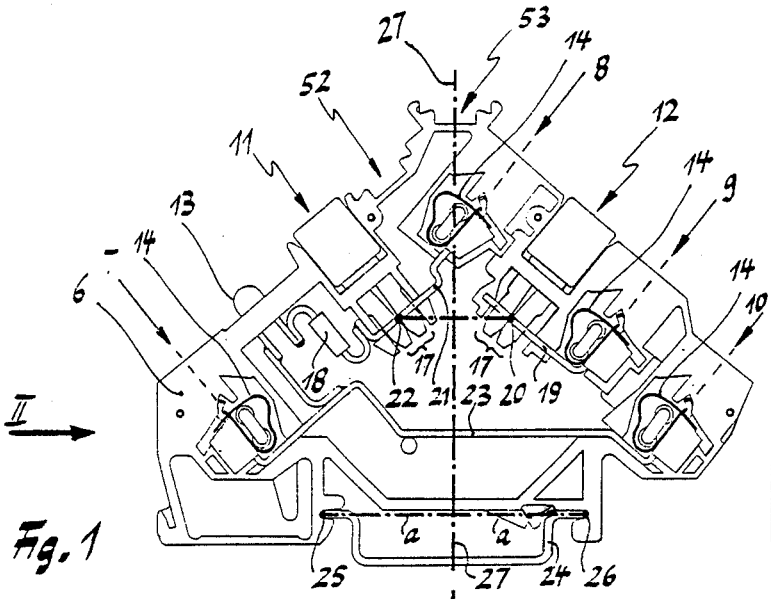
FIG. 1 a side view of the open side of a first embodiment of a series terminal pursuant to the invention, FIG. 2 a front view of the terminal pursuant to FIG. 1 in the direction of the arrow II, FIG. 3 a side view of a second embodiment of a series terminal pursuant to the invention, FIG. 4 a side view of a third embodiment of a series terminal pursuant to the invention, FIG. 5 a side view of a fourth embodiment of the series terminal pursuant to the invention.
Figure 2:
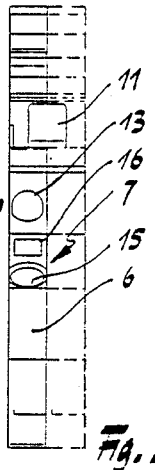

The series terminal illustrated in FIGS. 1 and 2 has an insulating housing 6 whose external contour is like that of a roof with two lateral diagonal roof surfaces, so that the contact points 7, 8, 9, and 10 located in the sloping roof surfaces, as well as the bridges 11 and 12 and the LED indicator 13 are easily visible and accessible.

Each contact point 7 through 10 has a clamping spring 14 in a known way to clamp an electrical conductor (not shown) inserted into the wire insertion opening 15 (cf. FIG. 2). Each contact point and clamping spring 14 can be opened by introducing a screwdriver or the like into the actuating opening 16 (cf. FIG. 2). For the engineering design of such known contact points in detail, refer to U.S. Pat. No. 4,171,861 or German Patent No. 27 06 482.

The bridges 11 and 12 are likewise of identical construction and are provided with two U-shaped plug-in tabs 17 bent toward one another as individual bridges, each of which is itself slotted again. Such bridges are also known and described in detail, for example, in U.S. Pat. No. 4,171,861 or German Patent No. 27 36 664.

The LED luminous diode 13 is commercial and is installed with a dropping resistor 18 in a known way.

There are power busses 19 inside the insulating housing. The power bus 19 connects the contact point 9 to the bridge 12 and has bridge connectors 20 in the form of slits in the power bus 19 through which the plug-in tab 17 of the bridge 12 is plugged into the power bus.

In the same way, the power bus 21 connects the contact point 8 with the bridge 11. In this case again, the bridge connectors 22 are pushed through slits in the power bus 21, into which the plug-in tab 17 of the bridge 11 is plugged.

The power bus 23 is designed as a through conductor and connects the two end contact points 7 and 10.

The LED indicator 13 in this example of embodiment is connected between the power bus 23 and the power bus 21, and indicates whether there is a different potential on the through conductor power bus 23 than on the power bus 21.

The terminal illustrated in FIG. 1 is latched to the assembly rail 24, which has an assembly rail profile pursuant to European Standard EN 50022, the shape of which has mirror symmetry. Thus, the illustrated series terminal has assembly rail latch base points 25 and 26 that are located at the same perpendicular distance a from the central plane 27 with mirror symmetry.

The central plane 27 at the same time is the plane of symmetry to the bridge connectors 20 and 22. These bridge connectors 20 and 22 are thus locate d on opposite sides and with mirror symmetry relative to the plane of symmetry 27.

FIG. 2 shows in solid lines a front view of the terminal pursuant to FIG. 1 in the direction of the arrow II, and indicates with dashes the adjacent position of another series terminal according to FIG. 1. The bridge 11 also drawn in FIG. 2 makes it clear that the bridge connectors 22 of these adjacent series terminals are connected electrically to one another by means of the bridge 11.

The insulating housing 6 illustrated in FIG. 1 has inscription grooves 52 and 53 extending in the direction of the assembly rail 24, with the groove 53 being positioned with mirror symmetry relative to the plane of symmetry 27 so that all of the inscription grooves 53 of adjacent series terminals located on the top are aligned with one another independently of whether the particular series terminal is latched to the assembly rail in the manner shown in FIG. 1, or rotated by 180°.

When the series terminal illustrated in FIG. 1 is used as an initiator terminal, the contact points 8 and 9 serve as supply wire contact points for the initiator. Ordinarily, the initiator is supplied with direct current. In that case, the negative wire of the initiator is connected to the contact point 8 and the positive wire of the initiator to the contact point 9.

The output line for the output signal of the initiator is connected to the contact point 10 of the through conductor power bus 23, so that the output signal of the initiator can be tapped at the contact point 7 of the through conductor power bus 23. The LED indicator 13 accordingly shows the circuit condition of the initiator, i.e., whether it is emitting an output signal.

The series terminal illustrated in FIG. 1 can also be used as a feeder terminal. In this case, the power supply lines are connected to the contact points 8 and 9. Starting from this feeder terminal, the adjacent series terminals that serve as initiator terminals are then supplied with power at the particular supply line contact points 8 and 9 through the bridges 11 and 12 and the bridge connectors 22 and 20.

Figure 3:
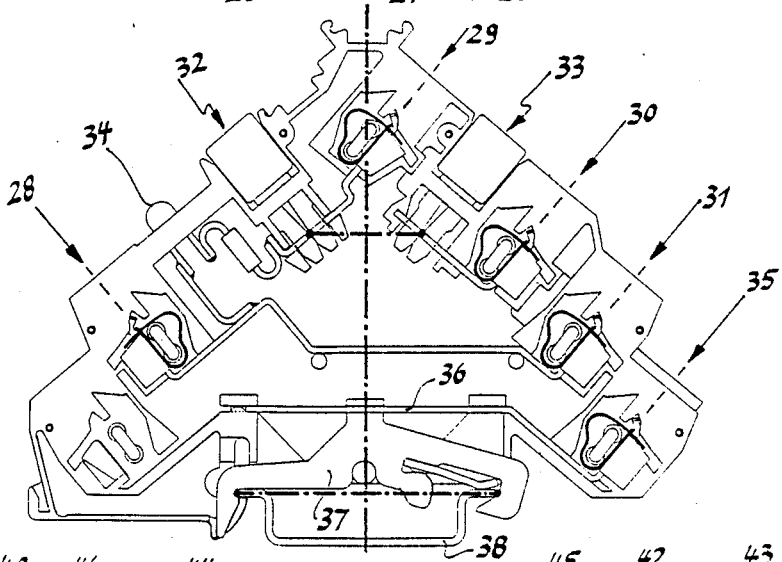

The construction of the series terminal illustrated in FIG. 3 can be compared in principle with the construction of the terminal of FIG. 1, so that it is not necessary to repeat the description of the contact points 28, 29, 30, and 31, or the bridges 32 and 33 and the LED indicator 34.

The series terminal illustrated in FIG. 3, however, has in addition a lower level in which is shown a ground line contact point 35 with a power bus 36, that contacts the assembly rail 38 through the ground base 37.

Figure 4:
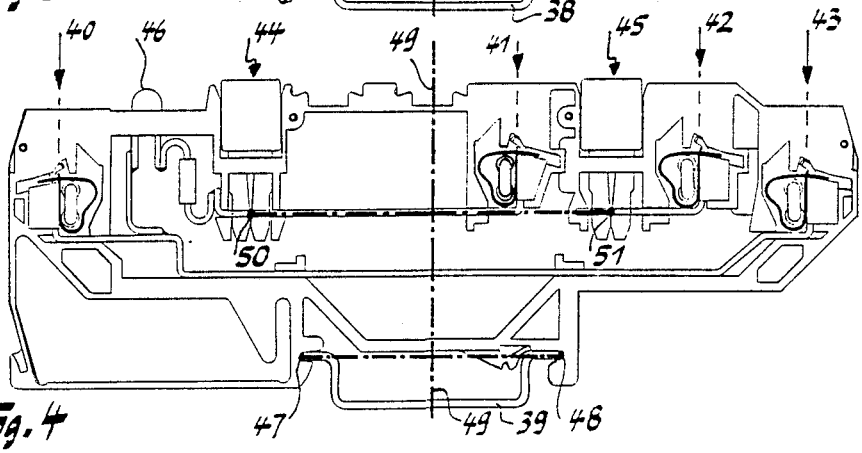

FIG. 4 illustrates a series terminal of the type pursuant to the invention that in contrast to the roof-shaped types of terminals of FIGS. 1 and 3, shows a horizontal extension of the series terminal perpendicular to the assembly rail, of low design.

Here again also, however, the contact points 40, 41, 42, and 43 and the bridges 44 and 45 and the LED indicator 46 have the same designs and are connected identically as in FIG. 1, so that it is not necessary to describe them again.

However, it should be clarified with reference to the terminal type of FIG. 4 that the teaching of the invention is not bound to one external contour of the series terminal. In the terminal illustrated in FIG. 4, the assembly rail latch base points 47 and 48 are again located on opposite sides of the central plane 49 and at the same perpendicular distance from this central plane 49. This central plane 49 in FIG. 4 is also at the same time the plane of symmetry 49 for the arrangement of the bridge connectors 50 and 51 of the particular associated supply line contact points 41 and 42 positioned with mirror symmetry, with both of them again pursuant to the invention being located on the same side of the plane of symmetry 49, namely on the right side of it as illustrated.

Figure 5:
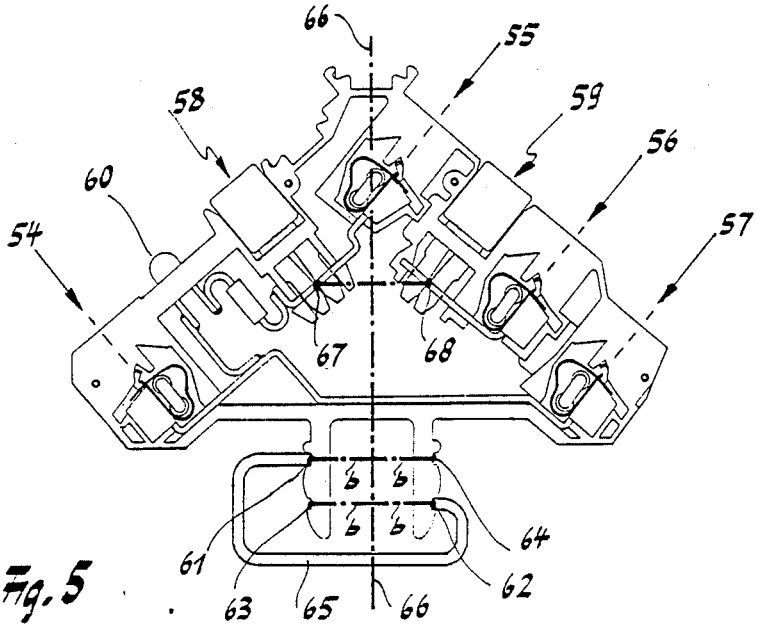

The series terminal pursuant to the invention illustrated in FIG. 5 is identical with the construction of the series terminal of FIG. 1 in its upper section, which has the contact points 54, 55, 56, and 57, as well as the bridges 58 and 59 and the LED indicator 60. Therefore, it is not necessary to describe them again.

However, the series terminal of FIG. 5 differs from the terminal of FIG. 1 in its lower section in the fact that it has a latch base with a total of four assembly rail latch base points 61, 62, and 63, 64, which permit latching this terminal to the illustrated asymmetric assembly rail profile 65, optionally rotated by 180°.

Here also again, the plane of symmetry 66 of the bridge connectors 67 and 68 at the same time is the central plane extending in the direction of the asymmetric assembly rail 65 between the assembly rail latch base points 61, 62 and 63, 64 located on opposite sides and at the same perpendicular distance b from the central plane.

I claim:

1. In a first series terminal of a type including a housing, first and second supply wire contacts in said housing and first and second bridge connectors in said housing electrically connected to said first and second supply wire contacts, respectively, said first series terminal being adapted to be received on an assembly rail having first and second latch base points which are symmetrically disposed about a central plane, said first and second bridge connectors being connectable with one or both of the first and second bridge connectors of a second series terminal of identical configuration through one or a pair of bridges when said second series terminal is received in an adjacent position on said assembly rail, the improvement comprising said first and second bridge connectors of said first series terminal being symmetrically disposed with respect to said central plane and said first and second supply wire contacts of said first series terminal being disposed on the same side of said central plane when said first series terminal is received on said assembly rail, whereby depending on the orientation of said second series terminal relative to said first series terminal when said first and second series terminals are assembled on said assembly rail, said first and second bridge connectors of said first series terminal can be alternatively electrically connected to the first and second bridge connectors, respectively, of said second series terminal or to the second and first bridge connectors, respectively, of said second series terminal in order to alternatively electrically connect the first and second supply wire contacts of said first series terminal to the first and second supply wire contacts, respectively, of said second series terminal or to the second and first contacts, respectively, of said second series terminal.

2. In the first series terminal of claim 1, said body portion having a groove formed therein which is symmetrical with respect to said central plane when said first series terminal is received on said assembly rail.

* * * * *